US008535024B2

(12) United States Patent
Conyers et al.

(10) Patent No.: US 8,535,024 B2
(45) Date of Patent: Sep. 17, 2013

(54) SAND PLUNGER FOR DOWNHOLE PUMP

(75) Inventors: Justin Conyers, Burleson, TX (US); Ian Douglas Rimmer, The Vines (AU); Bradley Craig Rogers, Grand Prairie, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 259 days.

(21) Appl. No.: 13/029,639

(22) Filed: Feb. 17, 2011

(65) Prior Publication Data

US 2012/0141310 A1 Jun. 7, 2012

(51) Int. Cl.
*F04B 39/00* (2006.01)
*F04B 53/14* (2006.01)
*F01B 31/00* (2006.01)

(52) U.S. Cl.
USPC ..... 417/430; 417/555.2; 92/87; 166/105.2

(58) Field of Classification Search
USPC ..... 417/430, 555.2; 92/87; 166/105.1, 166/105.4
See application file for complete search history.

(56) References Cited

U.S. PATENT DOCUMENTS 1,422,759 A * 7/1922 Green ..... 417/449
2,462,257 A * 2/1949 Cunningham ..... 92/252
4,049,365 A * 9/1977 Sparks, Sr. ..... 417/554
4,056,335 A 11/1977 Secrist
4,395,204 A * 7/1983 Turner ..... 417/554
4,509,365 A * 4/1985 Eineichner et al. ..... 73/152.61
5,372,488 A * 12/1994 Turner ..... 417/554
5,505,258 A 4/1996 Muth
5,618,169 A * 4/1997 Smith ..... 417/554
5,765,639 A 6/1998 Muth
5,934,372 A 8/1999 Muth
6,007,314 A * 12/1999 Nelson, II ..... 417/456
6,250,392 B1 6/2001 Muth
6,543,543 B2 4/2003 Muth
7,607,901 B2 * 10/2009 Williams et al. ..... 417/555.2
7,686,598 B2 3/2010 Williams
2008/0112826 A1 * 5/2008 Ford ..... 417/430

* cited by examiner

*Primary Examiner* — Charles Freay
(74) *Attorney, Agent, or Firm* — Geoffrey A. Mantooth

(57) ABSTRACT

A downhole pump has a barrel and plunger. The barrel has a first one-way valve and the plunger has a second done-way valve. The plunger reciprocates with respect to the barrel. The plunger has a first end which has a tapered leading edge. Ports are adjacent to the leading edge. The ports communicate with a passage in the plunger. A sucker rod string coupling is located at the plunger first end. The sucker rod string coupling is coupled to walls located between the ports. The end of the sucker rod string coupling that is coupled to the plunger is tapered so that fluid can flow out of the ports. The sucker rod string coupling and the plunger first end form an integral member that couples to the remainder of the plunger.

12 Claims, 4 Drawing Sheets

SAND PLUNGER FOR DOWNHOLE PUMP

FIELD OF THE INVENTION

The present invention relates to subsurface, or downhole, pumps, such as are used to pump oil and other fluids and bases from oil wells.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. A subsurface pump is located down in the well below the level of the oil. A string of sucker rods extends from the pump up to the surface to a pump jack device, or beam pump unit. A prime mover, such as a gasoline or diesel engine, or an electric motor, or a gas engine, on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing toward the surface.

In some wells, sand in the well fluid is a problem. "Sand" as used herein includes particulates that are found downhole, such as actual sand, scale, iron sulfides, etc. The sand abrades the upper parts of the plunger and may even enter between the plunger and the barrel, thereby degrading the fluid seal between the plunger and the barrel. Pump components in a sandy well require frequent replacement.

In the prior art, there is a plunger known as the "Farr" plunger that provides some measure of protection against sand. The plunger has a tapered leading edge that contacts sand. However, the plunger is lifted from the lower end. This causes the upper end of the plunger to wobble inside of the barrel and contributes to wear on both the plunger and the barrel.

SUMMARY OF THE INVENTION

A downhole pump comprises a barrel and a plunger. The barrel has barrel first and second ends and a first one-way valve. The plunger has plunger first and second ends and a second one-way valve. The plunger is located in the barrel so that one of the plunger or the barrel reciprocates with respect to the other of the plunger or the barrel. The plunger has an interior passage therethrough. The plunger second end is interposed between the barrel second end and the plunger first end. The plunger and the barrel form a compression chamber between the first and second one-way valves. The plunger first end has a tapered leading edge. Ports are adjacent to, and located radially inside of, the leading edge. The ports communicate with the passage. A sucker rod string coupling is located at the plunger first end.

In accordance with one aspect, the ports are oriented so that fluid exiting the plunger passage is directed toward the leading edge.

In accordance with one aspect, the sucker rod string coupling is coupled to a wall between the ports.

In accordance with another aspect, the sucker rod string coupling has first and second ends. The sucker rod string coupling second end is coupled to the plunger and is tapered so that fluid can flow out of the ports.

In accordance with still another aspect, the sucker rod string coupling and the plunger first end form an integral member that couples to the remainder of the plunger.

A plunger has first and second ends and a one-way valve. The plunger has an interior passage therethrough. The plunger first end has a tapered leading edge, with ports adjacent to, and located radially inside of, the leading edge. The ports communicate with the passage. A sucker rod string coupling is located at the plunger first end.

In accordance with one aspect, the ports are oriented so that fluid exiting the plunger passage is directed toward the leading edge.

In accordance with one aspect, the sucker rod string coupling is coupled to a wall between the ports.

In accordance with another aspect, the sucker rod string coupling has first and second ends. The sucker rod string coupling second end is coupled to the plunger and is tapered so that fluid can flow out of the ports.

In accordance with still another aspect, the sucker rod string coupling and the plunger first end form an integral member that couples to the remainder of the plunger.

DESCRIPTION OF THE PREFERRED EMBODIMENT

Figure 1:
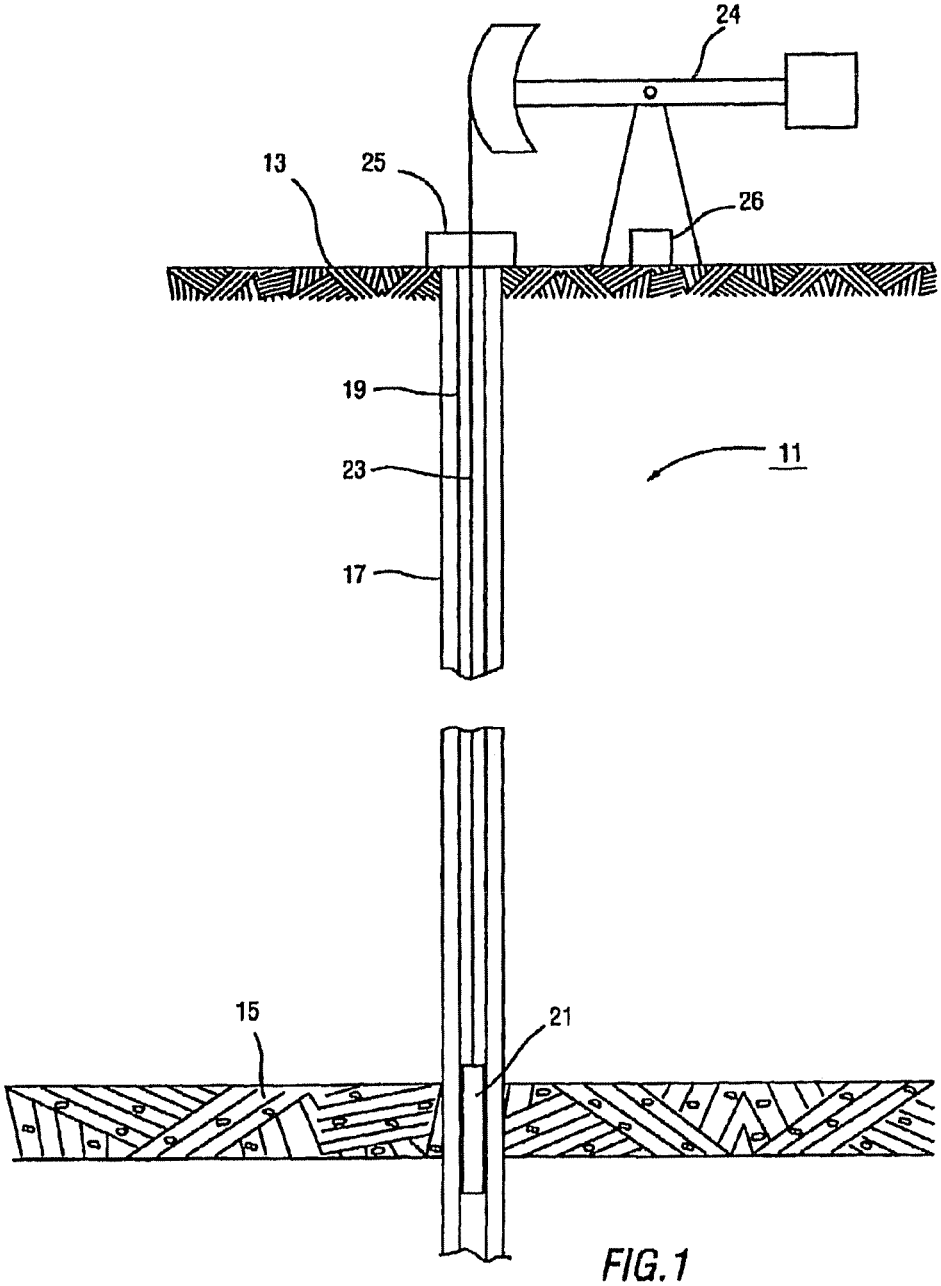
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other device or method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit, or beam pump unit, 24 which reciprocates up and down due to a prime mover 26, such as an electric motor or gasoline or diesel engine, or gas engine.

The pump 21 can be used with a variety of surface drive units besides a beam pump unit 24. For example, hydraulic pump units can be used, as well as belt type lifting units. Also, the pump can be used with a variety of connecting members besides sucker rods 23. For example, a wire line can be used.

Figure 2:
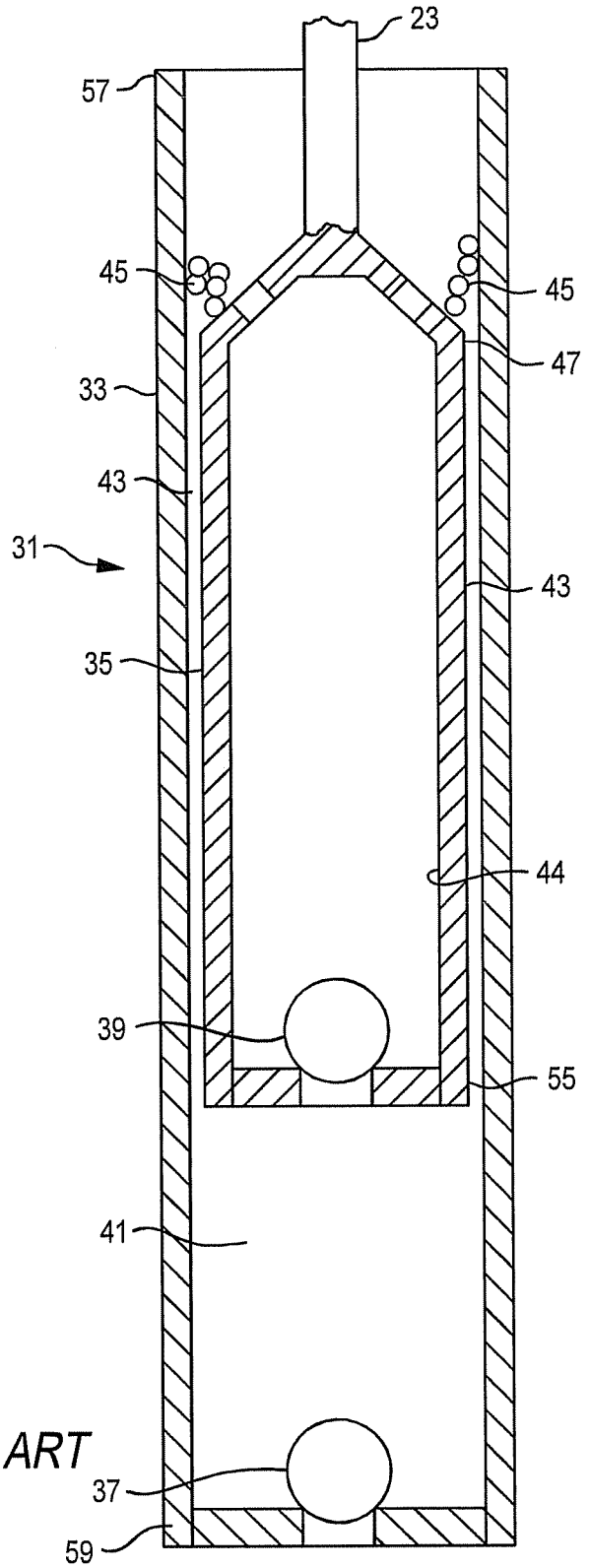
Fig. 2 PRIOR ART
FIG. 2 is a longitudinal cross-sectional schematic view of a prior art pump.

FIG. 2 illustrates a prior art pump 31. The pump has a barrel 33 and a plunger 35. The plunger 35 reciprocates with respect to the barrel 33. The barrel has a standing valve 37 and the plunger has a traveling valve 39. In the illustrations, the valve cage and other details are not shown.

The sucker rod string 23 is connected to the reciprocating member of the pump, which in FIG. 2 is the plunger. The plunger 35 is connected to a sucker rod or to a valve rod or some other component that is part of the reciprocating string of sucker rods. The connection between the sucker rod string and the reciprocating pump member can be made by a variety of devices, which are referred to herein as couplings. A coupling includes couplings (having box or female ends), bushings (having pin or male ends) and connectors (having both box and pin ends).

The plunger 35 is reciprocated by the sucker rod string 23. As the plunger 35 is raised on the upstroke, the traveling valve 39 is closed and the standing valve 37 is opened, wherein fluid is drawn into the compression chamber 41 between the two valves 37, 39. Thus, on the upstroke, the compression chamber 41 is charged with fluid. The fluid above the traveling valve 39 is lifted toward the surface. As the plunger 35 descends on the downstroke, the traveling valve 39 opens and the standing valve 37 closes, thereby forcing the fluid in the compression chamber 41 into the plunger.

The outside diameter of the plunger 35 is sized so as to provide a fluid seal 43 between the plunger and the barrel. The fluid seal is formed by the fluid entering a clearance between the plunger and the barrel. This clearance is typically 0.002-0.008 inches. The plunger 35 has an interior passage 44 for the flow of fluids through the plunger.

If the fluid contains sand 45, the plunger 35 exhibits wear. This is because on the upstroke, the plunger 35 moves up into the sand 45 that is in the fluid column just above the plunger. The top end 47 of the plunger 35 exhibits the most wear from the sand due to the upstroke motion and due to fluid pressure. The column of fluid in the tubing extending to the surface exerts pressure on the top end of the plunger. This fluid pressure tends to force fluid with sand between the plunger 35 and the barrel 33, independently of the movement of the plunger.

With the pump of the present invention, the plunger 51 (see FIG. 3) is modified so as to minimize damage and abrasion caused by the sand. In the description, like reference numbers may be used on like parts or components from figure to figure and between embodiments.

Figure 3:
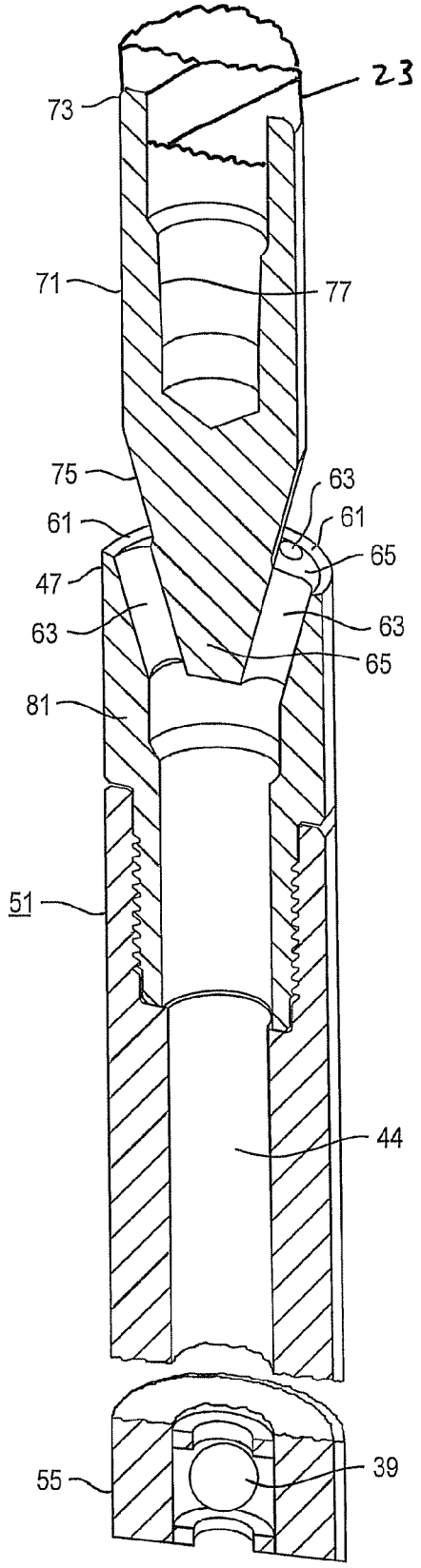
FIG. 3 is a longitudinal cross-sectional view of a plunger, in accordance with a preferred embodiment.

The plunger 51 has a top end 47 and a bottom end 55 (in the description, relative terms such as "top" and "bottom" refer to the orientations shown in FIGS. 1-3, however, the plunger and pump can be used in other orientations). The barrel 33 likewise has top and bottom ends 57, 59 (see FIG. 2). The plunger 51 is located in the barrel 33 so that the plunger bottom end 55 is interposed between the barrel bottom end 59 and the plunger top end 47 (see also FIG. 2, which shows plunger and barrel top and bottom ends). Thus, in reciprocating, the plunger bottom end 55 remains inside of the barrel, while the plunger top end 47 may, under certain pump configurations, egress the barrel or remain outside of the barrel.

Figure 4:
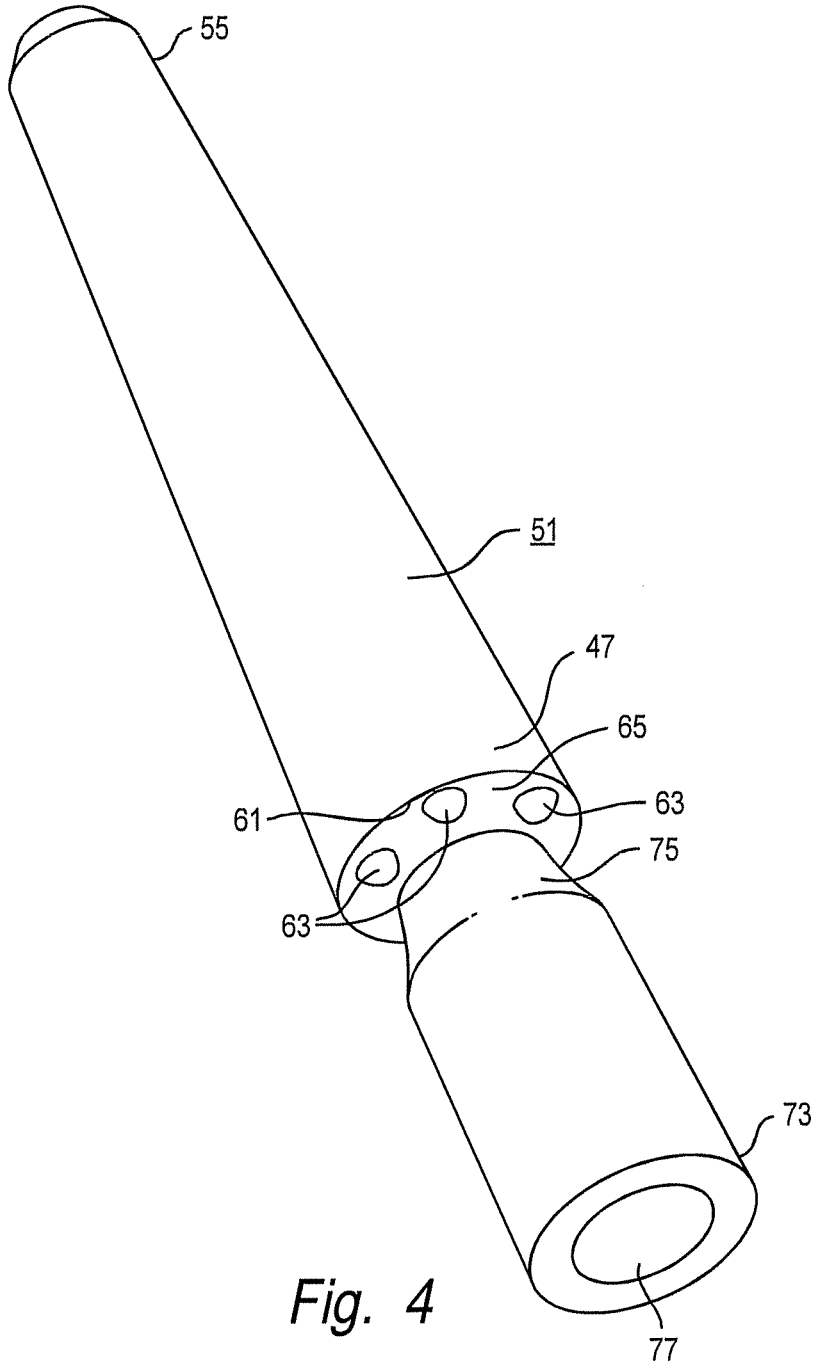
FIG. 4 is a top end perspective view of the plunger.

Referring to FIGS. 3 and 4, the plunger top end 47 has a leading edge 61. The leading edge is so called because on the upstroke, this edge is the first part of the plunger outside diameter that contacts sand and consequently is a part of the plunger that is subject to the highest amount of wear from sand. The leading edge 61 is tapered as shown in FIG. 3 so as to reduce the surface area that contacts sand on the upstroke. Thus, the leading edge forms an annular lip that is small in area. The tapering of the leading edge is accomplished by ports 63 in the top end 47 of the plunger, which ports are located radially inside of the leading edge 61. Located between the individual ports 63 is a wall (or walls) 65. The tapering of the leading edge 61 is also caused by the wall 65 being below the leading edge. (The line shown in FIG. 3 between the leading edge and the wall 65 is for illustrative purposes. The actual part may be fabricated without the line as shown in FIG. 4.) The wall 65 forms a shallow bowl or depression inside of the leading edge. The outside diameter of the plunger at the leading edge 61 is the same as the outside diameter for the remainder of the plunger. Thus, the taper is on the inside of the plunger.

The ports 63 perforate the wall 65 so as to allow fluid to exit the plunger interior passage. In the preferred embodiment, the ports 63 are angled so that the top end of each port is above and radially outward from the bottom end of the port. This orientation of the ports directs fluid exiting the plunger upwardly and outwardly over the leading edge 61. Fluid exiting the plunger (flowing up in the orientation of FIG. 3) thus carries away sand that has accumulated on the top end 47 of the plunger. In the preferred embodiment, there are six ports 63 spaced an equal distance apart. However, the number and size of the ports can vary.

The top end of the plunger is also provided with a coupling 71 to attach to the sucker rod string (either directly to sucker rods or to a valve rod). The coupling has a top end 73 and a bottom end 75. The top end 73 is cylindrical and, in the embodiment shown, has a threaded interior 77 for attaching to the sucker rod string 23 (see FIG. 1; in FIG. 3, the lower end of sucker rod string is shown schematically). The coupling top end 73 could have instead of a box end as shown in FIG. 3, a pin end, with male threads, or the top end 73 could have any alternative coupling or attachment. The bottom end 75 is coupled to the top end 47 of the plunger. The bottom end is tapered in its outside diameter. In the preferred embodiment, the tapering is frusto-conical, wherein the outside diameter of the coupling reduces from the cylindrical top end 73 to the plunger top end 47. This tapering allows fluid to exit the ports 63.

In the preferred embodiment, the coupling 71 and plunger top end 47 are provided in an integral member 81. This member 81 couples, such as by a threaded fitting or by soldering, to an end of the plunger 51. The other end of the plunger is a threaded fitting for receiving the valve cage. Providing the leading edge 61 on a member 81 that is separate from the remainder of the plunger provides advantages in both manufacturing and in use. In manufacturing, the plunger is essentially a tube with a high precision outside diameter and concentricity, while the member 81 requires some chamfering for the tapered leading edge 61 and boring for the angled ports 63. In use, if the leading edge 61 wears, but the remainder of the plunger remains undamaged, only the upper end member 81 need be replaced. The coupling 71 and plunger top end 47 need not be a single member but can be fabricated from two or more members.

During operation, the pump and plunger are reciprocated in a normal manner. On the upstroke, the plunger 51 is pulled up. The tapered leading edge 61 reduces the surface area of the plunger that contacts any sand and the fluid, so that wear on the leading edge and the plunger top end caused by the sand is reduced. The sand may accumulate on the wall 65. However, on the downstroke, fluid flows out of the plunger through the ports 63, which fluid washes and carries any sand on the plunger top end away. This washing effect further reduces contact of the sand with the plunger and reduces wear.

By coupling the sucker rod to the top end 47 of the plunger, the coupling is strong and is less likely to fail. In addition, the problem of wobble of the plunger top end 47, experienced by the prior art "Farr" plunger, is eliminated, as the plunger is pulled on the top stroke from the plunger top end.

The foregoing disclosure and showings made in the drawings are merely illustrative of the principles of this invention and are not to be interpreted in a limiting sense.

The invention claimed is:

1. A downhole pump, comprising:

a) a barrel having barrel first and second ends and a first one-way valve;

b) a plunger having plunger first and second ends, an outside diameter and a second one-way valve, the plunger located in the barrel so that one of the plunger or the barrel reciprocates with respect to the other of the plunger or the barrel, the plunger having an interior passage therethrough, the plunger second end being interposed between the barrel second end and the plunger first end, the plunger and the barrel forming a compression chamber between the first and second one-way valves;

c) the plunger first end having a leading edge at the outside diameter and a wall that tapers radially in from the leading edge so as to form a depression relative to the leading edge;

d) a sucker rod string coupling coupled to the wall at the plunger first end;

e) ports located so as to direct fluid from the depression upwardly and outwardly over the leading edge, the ports communicate with the interior passage.

2. The downhole pump of claim 1 wherein the sucker rod string coupling has first and second ends, the sucker rod string coupling second end is coupled to the plunger and is tapered so that fluid can flow out of the ports.

3. The downhole pump of claim 1 wherein the sucker rod string coupling and the plunger first end form an integral member that couples to the remainder of the plunger.

4. The downhole pump of claim 1 wherein:

a) the sucker rod string coupling has first and second ends, the sucker rod string coupling second end is coupled to the plunger and is tapered so that fluid can flow out of the ports;

b) the sucker rod string coupling and the plunger first end form an integral member that couples to the remainder of the plunger.

5. The downhole pump of claim 1 wherein each port having a diameter in circumferential direction, the spacing between the ports in the wall being the same as the port diameter.

6. The downhole pump of claim 4 wherein each port having a diameter in circumferential direction, the spacing between the ports in the wall being the same as the port diameter.

7. A plunger for a downhole pump, comprising:

a) first and second ends, an outside diameter and a one-way valve, the plunger having an interior passage therethrough;

b) the plunger first end having a leading edge at the outside diameter and a wall that tapers radially in from the leading edge so as to form a depression relative to the leading edge;

c) a sucker rod string coupling coupled to the wall at the plunger first end;

d) ports located so as to direct fluid from the depression upwardly and outwardly over the leading edge, the ports communicate with the interior passage.

8. The plunger of claim 7 wherein the sucker rod string coupling has first and second ends, the sucker rod string coupling second end is coupled to the plunger and is tapered so that fluid can flow out of the ports.

9. The plunger of claim 7 wherein the sucker rod string coupling and the plunger first end form an integral member that couples to the remainder of the plunger.

10. The plunger of claim 7 wherein:

a) the sucker rod string coupling has first and second ends, the sucker rod string coupling second end is coupled to the plunger and is tapered so that fluid can flow out of the ports;

b) the sucker rod string coupling and the plunger first end form an integral member that couples to the remainder of the plunger.

11. The plunger of claim 7 wherein each port having a diameter in circumferential direction, the spacing between the ports in the wall being the same as the port diameter.

12. The plunger of claim 10 wherein each port having a diameter in circumferential direction, the spacing between the ports in the wall being the same as the port diameter.

* * * * *